US006576415B2

(12) United States Patent
Uytterhoeven et al.

(10) Patent No.: US 6,576,415 B2
(45) Date of Patent: Jun. 10, 2003

(54) PHOTOTHERMOGRAPHIC MATERIALS WITH INCREA SED PHOTOSENSITIVITY

(75) Inventors: Herman Uytterhoeven, Bonheiden (BE); Johan Loccufier, Zwijnaarde (BE); Yvan Gilliams, Hever (BE)

(73) Assignee: AGFA-Gevaert (BE)

( * ) Notice: Subject to any disclaimer, the term of this patent is extended or adjusted under 35 U.S.C. 154(b) by 0 days.

(21) Appl. No.: 09/928,755

(22) Filed: Aug. 13, 2001

(65) Prior Publication Data

US 2002/0061484 A1 May 23, 2002

Related U.S. Application Data

(60) Provisional application No. 60/243,934, filed on Oct. 27, 2000.

(30) Foreign Application Priority Data

Sep. 11, 2000 (EP) ..... 00203136

(51) Int. Cl.[7] ..... G03C 1/498; G03C 1/005

(52) U.S. Cl. ..... 430/620; 430/617; 430/619; 430/631

(58) Field of Search ..... 430/617, 620, 430/619, 631

(56) References Cited

U.S. PATENT DOCUMENTS 3,615,533 A 10/1971 Rauner et al.

FOREIGN PATENT DOCUMENTS

EP 0715209 A 6/1996
EP 0754969 A 1/1997

OTHER PUBLICATIONS

U.S. patent application Ser. No. 09/934,806, Uytterhoeven et al., filed Aug. 22, 2001.
U.S. patent application Ser. No. 09/939,941, Uytterhoeven et al., filed Aug. 27, 2001.

*Primary Examiner*—Thorl Chea
(74) *Attorney, Agent, or Firm*—Leydig, Voit & Mayer, Ltd.

(57) ABSTRACT

A process for producing an aqueous dispersion comprising: preparing a dispersion of photosensitive silver halide and a binder or a surfactant in an aqueous medium; and subsequently either (a) adding a first silver salt to the silver halide dispersion and then adding a second silver salt; or (b) adding the second silver salt to the silver halide dispersion and then adding the first silver salt, wherein the aqueous dispersion is substantially free of a water-soluble metal or ammonium salt of an aliphatic carboxylic acid with greater than 12 carbon atoms, the first silver salt is a substantially light-insensitive and substantially water-insoluble silver salt of an organic carboxylic acid, and the second silver salt has a water-solubility greater than 0.1 g in 1 L of water at 20° C.; an aqueous dispersion obtainable therewith; a photothermographic recording material prepared with the aqueous dispersion; and a process for preparing the photothermographic recording material. In addition the use of the second silver salt for increasing the sensitivity of a photothermographic recording material is provided.

23 Claims, No Drawings

PHOTOTHERMOGRAPHIC MATERIALS WITH INCREA SED PHOTOSENSITIVITY

This application claims the benefit of U.S. Provisional Application No. 60/243,934, filed Oct. 27, 2000, which is incorporated by reference.

FIELD OF THE INVENTION

The present invention relates to an aqueous dispersion of a substantially light-insensitive organic silver salt and a photosensitive silver halide and a photothermographic recording material prepared therefrom.

BACKGROUND OF THE INVENTION

EP-A 754 969 discloses a process for producing a suspension of particles containing a substantially light-insensitive silver salt of an organic carboxylic acid, comprising simultaneous metered addition of an aqueous solution or suspension of an organic carboxylic acid or its salt; and an aqueous solution of a silver salt to an aqueous liquid, wherein the metered addition of the aqueous solution or suspension of the organic carboxylic acid or its salt; and/or the aqueous solution of the silver salt is regulated by the concentration of silver ions or the concentration of anions of the silver salt in the aqueous liquid. In preferred embodiments of this process after completion of the production of the aqueous suspension of the particles, excess dissolved silver ions are converted into at least one silver salt and the particles of substantially light-insensitive silver salt of an organic carboxylic acid are produced in the presence of silver halide particles.

EP-A 851 285 discloses a process for producing an aqueous dispersion I containing particles including a substantially light-insensitive organic heavy metal salt A with a solubility in 1 L of water of less than $10^{-2}$ g at 20° C. comprising the steps of: (i) producing an aqueous dispersion II containing particles including a salt B with a solubility in 1 L of water between 15 g and 0.01 g at 20° C.; and (ii) converting the salt B in the particles of the aqueous dispersion II into the organic heavy metal salt A, characterized in that the organic heavy metal salt A and the salt B have a common cation.

It is known [see e.g. The Theory of the Photographic Process Fourth Edition, Ed. T. H. James, Eastman Kodak (1977), pages 157–158] that decreased coating pAg (=increased UAg) increases emulsion photosensitivity in conventional silver halide emulsion materials and that this effect is reversible i.e. increased coating pAg (=decreased UAg) reduces the photosensitivity in conventional silver halide emulsion materials. The addition of a soluble silver salt to a dispersion of photosensitive silver halide prior to coating produces a photographic material with a high fog level.

A principal problem in developing photothermographic recording materials with photo-addressable thermally developable elements coated from aqueous media is their lower photosensitivity than photothermographic recording materials with photo-addressable thermally developable elements coated from solvent media. A means is therefore necessary to boost the photosensitivity of photo-addressable thermally developable elements coated from aqueous media, so that the environmental and economic benefits of coating from aqueous media can be realized.

ASPECTS OF THE INVENTION

It is therefore an aspect of the invention to provide a means of increasing the photosensitivity of photothermographic recording materials coated from aqueous media.

It is therefore a further aspect of the invention to provide a photothermographic recording material with increased photosensitivity whose photo-addressable thermally developable element is coated from aqueous media.

It is therefore a further aspect of the invention to provide an aqueous dispersion for use in providing a photothermographic recording material with increased photosensitivity whose photo-addressable thermally developable element is coated from aqueous media.

It is therefore a still further aspect of the invention to provide a process for producing an aqueous dispersion for use in providing a photothermographic recording material with increased photosensitivity.

Further aspects and advantages of the invention will become apparent from the description hereinafter.

SUMMARY OF THE INVENTION

Whereas in convention photographic emulsions addition of a soluble silver salt to a dispersion of photosensitive silver halide prior to coating produces a photographic material with a very high fogging level, it has been surprisingly found that the addition of a silver salt with a water-solubility greater than 0.1 g/L water to an aqueous dispersion of a substantially light-insensitive and substantially water-insoluble organic silver salt, a photosensitive silver halide, and a binder increases the photosensitivity of a photo-addressable thermally developable element containing a reducing agent for the organic silver salt and a layer produced by coating the aqueous dispersion onto a support without increasing the background density of prints produced therewith.

The above mentioned aspects are realized by a process for producing an aqueous dispersion comprising in the following order the steps of: (i) preparing a dispersion of photosensitive silver halide and a binder or a surfactant in an aqueous medium; (ii) adding a first silver salt to the dispersion prepared in step (i); and (iii) adding a second silver salt to the dispersion prepared in step (ii), wherein the aqueous dispersion is substantially free of a water-soluble metal or ammonium salt of an aliphatic carboxylic acid with greater than 12 carbon atoms, the first silver salt is a substantially light-insensitive and substantially water-insoluble silver salt of an organic carboxylic acid, and the second silver salt has a water-solubility greater than 0.1 g in 1 L of water at 20° C.

The above mentioned aspects are further realized by a process for producing an aqueous dispersion comprising in the following order the steps of: (i) preparing a dispersion of photosensitive silver halide and a binder or a surfactant in an aqueous medium; (ii) adding a second silver salt to the dispersion prepared in step (i); and (iii) adding a first silver salt to the dispersion prepared in step (ii), wherein the aqueous dispersion is substantially free of a water-soluble metal or ammonium salt of an aliphatic carboxylic acid with greater than 12 carbon atoms, the first silver salt is a substantially light-insensitive and substantially water-insoluble silver salt of an organic carboxylic acid, and the second silver salt has a water-solubility greater than 0.1 g in 1 L of water at 20° C.

The above-mentioned aspects are also realized by an aqueous dispersion obtainable with either of the above-mentioned processes.

The above-mentioned aspects are also realized by the use of a second silver salt with a water-solubility greater than 0.1 g/L water at 20° C. for increasing the sensitivity of a photothermographic recording material thermally developable under substantially water-free conditions, the photothermographic recording material having a photo-addressable thermally developable element, the photo-addressable thermally developable element containing a first silver salt, a reducing agent therefor in thermal working relationship therewith and a binder, wherein the aqueous dispersion is substantially free of a water-soluble metal or ammonium salt of an aliphatic carboxylic acid with greater than 12 carbon atoms and the first silver salt is a substantially light-insensitive and substantially water-insoluble silver salt of an organic carboxylic acid.

The above-mentioned aspects are also realized by a photothermographic recording material thermally developable under substantially water-free conditions, the photothermographic recording material comprising a support and a photo-addressable thermally developable element, the photo-addressable thermally developable element fulfilling two requirements:

(i) the photo-addressable thermally developable element contains a first silver salt as defined above, a reducing agent therefor in thermal working relationship therewith, a photosensitive silver halide and a binder; and (ii) the photo-addressable thermally developable element comprises a layer obtainable by coating the above-mentioned aqueous dispersion onto the support.

The above-mentioned aspects are also realized by a process for preparing a photothermographic recording material thermally developable under substantially water-free conditions, the photothermographic recording material comprising a support and a photo-addressable thermally developable element and the photo-addressable thermally developable element containing a photosensitive silver halide, a first silver salt, a reducing agent therefor in thermal working relationship therewith and a binder, comprising the steps of: (i) coating the above-described aqueous dispersion onto a support; and (ii) drying the layer formed in step (i).

Further preferred embodiments of the present invention are disclosed in the dependent claims.

DETAILED DESCRIPTION OF THE INVENTION

Definitions

The term aqueous for the purposes of the present invention means containing at least 60% by volume of water, preferably at least 80% by volume of water, and optionally containing water-miscible organic solvents such as alcohols e.g. methanol, ethanol, 2-propanol, butanol, iso-amyl alcohol, octanol, cetyl alcohol etc.; glycols e.g. ethylene glycol; glycerine; N-methyl pyrrolidinone; methoxypropanol; and ketones e.g. 2-propanone and 2-butanone etc.

Substantially free of a water-soluble metal or ammonium salt of an aliphatic carboxylic acid with greater than 12 carbon atoms means that a water-soluble metal or ammonium salt of an aliphatic carboxylic acid with greater than 12 carbon atoms is not intentionally present and if present is only present in trace quantities.

The term water-soluble salt means salts with a solubility in water at 20° C. of at least 2 mg/L. The term metal or ammonium salt of an aliphatic carboxylic acid with greater than 12 carbon atoms, includes lithium, potassium, sodium, rubidium, caesium and ammonium salts of aliphatic carboxylic acids, such as behenic and stearic acid, and mixtures thereof.

Substantially light-insensitive means not intentionally light sensitive and resistant to darkening upon exposure.

Substantially water-insoluble means a solubility in water at 20° C. of less than 2 mg/L.

S is defined as that exposure in $mJ/m^2$ at which the photothermographic recording material attained an optical density of 1.0 above Dmin. Thus the lower the value of S, the higher the photosensitivity of the photothermographic recording material.

The UAg of an aqueous liquid is defined in this specification as the potential difference between a silver electrode (of 99.99% purity) in the aqueous liquid and a reference electrode consisting of a Ag/AgCl-electrode in 3M KCl solution at room temperature connected with the liquid via a salt bridge consisting of a 10% $KNO_3$ salt solution.

By the term "heat solvent" in this specification is meant a non-hydrolyzable organic material which is in solid state in the recording layer at temperatures below 50° C. but becomes a plasticizer for the recording layer in the heated region and/or liquid solvent for at least one of the redox-reactants, e.g. the reducing agent for the first silver salt, at a temperature above 60° C.

By thermally developable under substantially water-free conditions as used is the present specification, means heating at a temperature of 80° to 250° C. under conditions in which the reaction system is approximately in equilibrium with water in the air, and water for inducing or promoting the reaction is not particularly or positively supplied from the exterior of the thermographic recording material. Such a condition is described in T. H. James, "The Theory of the Photographic Process, Fourth Edition, Macmillan 1977", page 374.

First Silver Salt

The first silver salt is a substantially light-insensitive and substantially water-insoluble silver salt of an organic carboxylic acid having as its organic group: aryl, aralkyl, alkaryl or alkyl groups. Aliphatic carboxylic acids known as fatty acids, wherein the aliphatic carbon chain has preferably at least 12 C-atoms, are preferred e.g. silver laurate, silver palmitate, silver stearate, silver hydroxystearate, silver oleate, silver behenate and silver arichidate, which silver salts are also called "silver soaps". Other silver salts of an organic carboxylic acid as described in GB 1,439,478, e.g. silver benzoate, and silver salts of organic carboxylic acids described in Research Disclosure 17029, but excluding silver salts of organic carboxylic acids substituted with a heterocyclic thione group as disclosed in Research Disclosure 12542 and U.S. Pat. No. 3,785,830, may also be used to produce a thermally developable silver image. Combinations of the first silver salts may also be used in the present invention. Aqueous dispersions of first silver salts or mixtures thereof can be produced as described in U.S. Pat. No. 5,891,616 and EP-A 848286 and U.S. Pat. No. 3,839,049.

Second Silver Salt

The second silver salt in the aqueous dispersion of the present invention has a solubility in water at 20° C. of greater than 0.1 g/L, with greater than 1 g/L being preferred.

Suitable second silver salts in the aqueous dispersion of the present invention include silver nitrate, silver acetate, silver propionate, silver butyrate, silver isobutyrate, silver tartrate, silver salicylate, silver malonate, silver succinate, silver lactate and silver oxalate. The solubilities of some of these salts are given below:

| | Solubility in water at 20° C. in g/L water |
|---|---|
| silver nitrate | 2150 |
| silver fluoride | 1800 (at 25° C.) |
| silver dithionate | 500 (at 16° C.) |
| silver acetate# | 10.4 |
| silver propionate# | 8.4 |
| silver sulphate | 7.7 (at 18° C.) |
| silver butyrate# | 4.9 |
| silver metaphosphate | 3.2 |
| silver benzoate | 2.17 |
| silver tartrate# | 2.01 (at 18° C.) |
| silver nitrite | 4.2 (at 25° C.) |
| silver selenate | 1.2 |
| silver salicylate | 0.8 (at 18° C.) |
| silver hyponitrite | 0.75 (at 13° C.) |
| silver malonate# | 0.57 |
| silver tungstate | 0.5 (at 15° C.) |
| silver succinate# | 0.18 (at 18° C.) |
| silver lactate# | |

Silver salts marked with # are themselves photosensitive although no deterioration in the level of image background has been observed upon adding the second silver salt, when such salts are used.

It is known in silver halide photography that addition of soluble silver salts to a dispersion of a silver halide produces an increase in UAg (=decrease in pAg=an increase in free silver ion concentration), which can result in partial reduction of the silver salts present, thereby producing metallic silver nuclei. Such metallic silver nuclei give rise to an increased fogging level in silver halide photographic materials. It is possible that an analogous effect is the basis for the sensitivity increase arising from the present invention.

Photosensitive Silver Halide

The photosensitive silver halide used in the present invention may be employed in a range of 0.1 to 100 mol percent; preferably, from 0.2 to 80 mol percent; particularly preferably from 0.3 to 50 mol percent; especially preferably from 0.5 to 35 mol %; and especially from 1 to 12 mol % of substantially light-insensitive organic silver salt.

The silver halide may be any photosensitive silver halide such as silver bromide, silver iodide, silver chloride, silver bromoiodide, silver chlorobromoiodide, silver chlorobromide etc. The silver halide may be in any form which is photosensitive including, but not limited to, cubic, orthorhombic, tabular, tetrahedral, octagonal etc. and may have epitaxial growth of crystals thereon.

The silver halide used in the present invention may be employed without modification. However, it may be chemically sensitized with a chemical sensitizing agent such as a compound containing sulphur, selenium, tellurium etc., or a compound containing gold, platinum, palladium, iron, ruthenium, rhodium or iridium etc., or a combination thereof. The details of these procedures are described in T. H. James, "The Theory of the Photographic Process", Fourth Edition, Macmillan Publishing Co. Inc., New York (1977), Chapter 5, pages 149 to 169.

The grain size of the silver halide particles can be determined by the Moeller Teller method in the sample containing silver halide particles is sedimented upon a filter paper, which is submerged in electrolyte together with a negative platinum needle-shaped electrode and a reference electrode. The silver halide particles on the filter paper are slowly scanned individually with the needle-shaped electrode, whereupon the silver halide grains are individually electrochemically reduced at the cathode. This electrochemical reduction is accompanied by a current pulse, which is registered as a function of time and integrated to give the charge transfer Q for the electrochemical reduction of the silver halide particle, which is proportional to its volume. From their volume the equivalent circular grain diameter of each grain can be determined and therefrom the average particle size and size distribution.

Processes for Preparation of an Aqueous Dispersion

A process for producing an aqueous dispersion is provided by the instant invention comprising: preparing a dispersion of photosensitive silver halide and a binder or a surfactant in an aqueous medium; and subsequently either (a) adding a first silver salt to the silver halide dispersion and then adding a second silver salt; or (b) adding the second silver salt to the silver halide dispersion and then adding the first silver salt, wherein the aqueous dispersion is substantially free of a water-soluble metal or ammonium salt of an aliphatic carboxylic acid with greater than 12 carbon atoms, the first silver salt is a substantially light-insensitive and substantially water-insoluble silver salt of an organic carboxylic acid, and the second silver salt has a water-solubility greater than 0.1 g in 1 L of water at 20° C.

In the process of the present invention incorporating option (a) it is preferred that the silver behenate not be prepared in the presence of silver halide.

Such processes exclude the synthesis process of the first silver salt as can be seen from the absence from the aqueous dispersion of a metal or ammonium salt of an aliphatic carboxylic acid with greater than 12 carbon atoms.

The binder used for dispersing the photosensitive silver halide may a water-dispersible or a water-soluble binder. Suitable water-soluble binders are: polyvinyl alcohol, polyacrylamide, polymethacrylamide, polyacrylic acid, polymethacrylic acid, polyethyleneglycol, polyvinylpyrrolidone, proteinaceous binders such as gelatine, modified gelatines such as phthaloyl gelatine, polysaccharides, such as starch, gum arabic and dextran and water-soluble cellulose derivatives.

The surfactant used for dispersing the photosensitive silver halide is preferably a anionic or non-ionic surfactant, with anionic sulfonate surfactants being particularly preferred.

In a preferred embodiment of the process for producing an aqueous dispersion incorporating option (b), according to the present invention, there is an increase in UAg between step (i) and step (ii), UAg being the potential difference between a silver electrode (of ≧99.99% purity) in the aqueous liquid and a reference electrode consisting of a Ag/AgCl-electrode in 3M KCl solution at room temperature connected with the liquid via a salt bridge consisting of a 10% $KNO_3$ salt solution. The UAg increase due to adding the second silver salt is preferably at least 50 mV, with at least 100 mV being particularly preferred.

In a further preferred embodiment of the process for producing an aqueous dispersion incorporating option (b), according the present invention, there is an decrease in UAg between step (ii) and step (iii), UAg being the potential difference between a silver electrode (of ≧99.99% purity) in the aqueous liquid and a reference electrode consisting of a Ag/AgCl-electrode in 3M KCl solution at room temperature connected with the liquid via a salt bridge consisting of a 10% $KNO_3$ salt solution.

In a still further preferred embodiment of the process for producing an aqueous dispersion, according to the present invention, aqueous ammonia is added such that the pH of the aqueous dispersion does not exceed a value of 9.0. At higher pH-values silver hydroxide and silver oxide are formed, which cause increased image background (Dmin) levels.

According to the processes for producing an aqueous emulsion according to the present invention the second silver salt can be added as an aqueous solution, dissolved in a small quantity of water-miscible organic solvent or as a slurry in water, although in the latter case the particles of second silver salt must dissolve during the production of the aqueous emulsion.

The water-solubility of the second silver salt mainly influences the preparation time of the aqueous dispersion, since the increase in photosensitivity is dependent upon ionic dissociation of the second silver salt in the aqueous medium. The water-solubility of the second silver salt is therefore greater than 0.1 g in 1 L of water at 20° C.

The binder or surfactant is necessary to keep the substantially light-insensitive and water insoluble organic silver salt and the photosensitive silver halide in suspension.

In a preferred embodiment of the process for preparing an aqueous dispersion, according to the present invention, the second silver salt is selected from the group consisting of silver nitrate, silver acetate, silver lactate and silver sulphate.

Aqueous Dispersion

The present invention provides an aqueous dispersion obtainable by the above-mentioned processes for preparing an aqueous dispersion.

In a preferred embodiment of the aqueous dispersion, according to the present invention, the quantity of second silver salt added is at least 1 mol % with respect to the quantity of the photosensitive silver halide and preferably at least 15 mol % with respect to the quantity of the photosensitive silver halide. The quantity of second silver salt is preferably also less than 80 mol % with respect to the quantity of the photosensitive silver halide. The particle size of the photosensitive silver halide is preferably between 70 and 100 nm.

In a still further preferred embodiment of the aqueous dispersion according to the present invention, the aqueous dispersion further contains a reducing agent for the first silver salt.

Organic Reducing Agents

Suitable organic reducing agents for the reduction of the first silver salt particles are organic compounds containing at least one active hydrogen atom linked to O, N or C, such as is the case with: aromatic di- and tri-hydroxy compounds; aminophenols; METOL™; p-phenylene-diamines; alkoxynaphthols, e.g. 4-methoxy-1-naphthol described in U.S. Pat. No. 3,094,41; pyrazolidin-3-one type reducing agents, e.g. PHENIDONE™; pyrazolin-5-ones; indan-1,3-dione derivatives; hydroxytetrone acids; hydroxytetronimides; hydroxylamine derivatives such as for example described in U.S. Pat. No. 4,082,901; hydrazine derivatives; and reductones e.g. ascorbic acid; see also U.S. Pat. Nos. 3,074,809, 3,080,254, 3,094,417 and 3,887,378. Particularly suitable reducing agents are sterically hindered phenols, bisphenols, sulfonamidophenols and those described in WO97/04357.

Combinations of reducing agents may also be used that on heating become reactive partners in the reduction of the substantially light-insensitive silver salt of an organic carboxylic acid. For example, combinations of sterically hindered phenols with sulfonyl hydrazide reducing agents such as disclosed in U.S. Pat. No. 5,464,738; trityl hydrazides and formyl-phenyl-hydrazides such as disclosed in U.S. Pat. No. 5,496,695; trityl hydrazides and formyl-phenyl-hydrazides with diverse auxiliary reducing agents such as disclosed in U.S. Pat. No. 5,545,505, U.S. Pat. No. 5,545,507 and U.S. Pat. No. 5,558,983; acrylonitrile compounds as disclosed in U.S. Pat. No. 5,545,515 and U.S. Pat. No. 5,635,339; and 2-substituted malonodialdehyde compounds as disclosed in U.S. Pat. No. 5,654,130

Photo-Addressable Thermally Developable Element

According to the present invention, the photothermographic recording material thermally developable under substantially water-free conditions of the present invention comprises a support and a photo-addressable thermally developable element, which fulfills two requirements: (i) it contains a first silver salt, a reducing agent therefor in thermal working relationship therewith, a photosensitive silver halide and a binder; and (ii) it comprises a layer obtainable by coating an aqueous dispersion, according to the present invention.

These two requirements will overlap in that the aqueous dispersion contains a binder or a surfactant, a first silver salt, a photosensitive silver halide, a second silver salt and optionally contains a reducing agent for the first silver salt, a spectral sensitizer, a supersensitizer, one or more stabilizers and a binder.

The photo-addressable thermally developable element may comprise a single layer, i.e. produced with the aqueous dispersion according to the present invention, or may comprise more than one layer, one of which is produced with the aqueous dispersion and the others containing the other ingredients necessary for image formation e.g. a reducing agent for the first silver salt, a binder, a toning agent and one or more stabilizers. In this layer system the photosensitive silver halide should be in catalytic association with the substantially light-insensitive silver salt of an organic carboxylic acid, the spectral sensitizer should be optionally together with a supersensitizer in intimate sensitizing association with the silver halide particles and the other ingredients active in the thermal development process or pre- or post-development stabilization of the element should be in the same layer or in other layers with the proviso that the organic reducing agent and the toning agent, if present, should be in thermal working relationship with the substantially light-insensitive silver salt of an organic carboxylic acid i.e. during the thermal development process the reducing agent and the toning agent, if present, are able to diffuse to the substantially light-insensitive silver salt of an organic carboxylic acid. The photo-addressable thermally developable element may also be coated with a protective layer.

Binders for the Photo-Addressable Thermally Developable Element

The film-forming binder for use in the aqueous dispersion and photo-addressable thermally developable element of the present invention may a water-dispersible or a water-soluble binder.

Suitable water-soluble film-forming binders are: polyvinyl alcohol, polyacrylamide, polymethacrylamide, polyacrylic acid, polymethacrylic acid, polyethyleneglycol, polyvinylpyrrolidone, proteinaceous binders such as gelatine, modified gelatines such as phthaloyl gelatine, polysaccharides, such as starch, gum arabic and dextran and water-soluble cellulose derivatives.

Suitable water-dispersible binders are any water-insoluble polymers e.g. water-insoluble cellulose derivatives, polyurethanes, polyesters polycarbonates and polymers derived from α,β-ethylenically unsaturated compounds such as after-chlorinated polyvinyl chloride, partially hydrolyzed polyvinyl acetate, polyvinyl acetals, preferably polyvinyl butyral, and homopolymers and copolymers produced using monomers selected from the group consisting of: vinyl chloride, vinylidene chloride, acrylonitrile, acrylamides, methacrylamides. methacrylates, acrylates, methacrylic acid, acrylic acid, vinyl esters, styrenes, dienes and alkenes; or mixtures thereof.

Preferred water-dispersible binders are water-dispersible film-forming polymers with covalently bonded ionic groups selected from the group consisting of sulfonate, sulfinate, carboxylate, phosphate, quaternary ammonium, tertiary sulfonium and quaternary phosphonium groups. Further preferred water-dispersible binders are water-dispersible film-forming polymers with covalently bonded moieties with one or more acid groups.

It should be noted that, in the case of very small polymer particles, there is no clear cut transition between a polymer dispersion and a polymer solution.

Water-dispersible binders with crosslinkable groups, e.g. epoxy groups, aceto-acetoxy groups and crosslinkable double bonds are also preferred. Preferred water-dispersible binders for use in the photo-addressable thermally developable element of the present invention are polymer latexes as disclosed in WO 97/04355.

The above mentioned binders or mixtures thereof may be used in conjunction with waxes or "heat solvents" also called "thermal solvents" or "thermosolvents" improving the reaction speed of the redox-reaction at elevated temperature.

Spectral Sensitizer

The aqueous dispersion or photo-addressable thermally developable element of the photothermographic recording material, according to the present invention, may contain a spectral sensitizer, optionally together with a supersensitizer, for the silver halide appropriate for the wavelength of the light source which may in the near UV, visible, e.g. 630 nm, 670 nm etc., or IR, parts of spectrum. The silver halide may be spectrally sensitized with various known dyes including cyanine, merocyanine, styryl, hemicyanine, oxonol, hemioxonol and xanthene dyes optionally, particularly in the case of sensitization to infra-red radiation, in the presence of a so-called supersensitizer. Useful cyanine dyes include those having a basic nucleus, such as a thiazoline nucleus, an oxazoline nucleus, a pyrroline nucleus, a pyridine nucleus, an oxazole nucleus, a thiazole nucleus, a selenazole nucleus and an imidazole nucleus. Useful merocyanine dyes which are preferred include those having not only the above described basic nuclei but also acid nuclei, such as a thiohydantoin nucleus, a rhodanine nucleus, an oxazolidinedione nucleus, a thiazolidinedione nucleus, a barbituric acid nucleus, a thiazolinone nucleus, a malononitrile nucleus and a pyrazolone nucleus. In the above described cyanine and merocyanine dyes, those having imino groups or carboxyl groups are particularly effective.

Supersensitizers

According to the present invention the aqueous dispersion or photo-addressable thermally developable element may further include a supersensitizer. Preferred supersensitizers are selected from the group of compounds consisting of: mercapto-compounds, disulfide-compounds, stilbene compounds, organoborate compounds and styryl compounds.

Toning Agents

In order to obtain a neutral black image tone in the higher densities and neutral grey in the lower densities, the aqueous dispersion or photo-addressable thermally developable element according to the present invention may contain one or more toning agents. The toning agents should be in thermal working relationship with the first silver salt and reducing agent therefor during thermal processing.

Stabilizers and Antifoggants

In order to obtain improved shelf-life and reduced fogging, stabilizers and antifoggants such as phenyl tribromomethyl sulphone, 4-methyl phthalic acid and 2-mercapto-4-heptyl-oxadiazole may be incorporated into the photo-addressable thermally developable elements or the aqueous dispersion of the present invention.

Support

The support for the photothermographic recording material according to the present invention may be transparent, translucent or opaque and is preferably a thin flexible carrier made e.g. from paper, polyethylene coated paper or transparent resin film, e.g. made of a cellulose ester, e.g. cellulose triacetate, polypropylene, polycarbonate or polyester, e.g. polyethylene terephthalate. The support may be in sheet, ribbon or web form. The support may be subbed with a subbing layer. It may also be made of an opacified resin composition.

Antihalation Dyes

The photothermographic recording materials used in the present invention may also contain antihalation or acutance dyes which absorb light which has passed through the photosensitive thermally developable photographic material, thereby preventing its reflection. Such dyes may be incorporated into the photo-addressable thermally developable element or in any other layer of the photothermographic material of the present invention.

Antistatic Layer

In a preferred embodiment the photothermographic recording material of the present invention an antistatic layer is applied to is an outermost layer.

Surfactants and Dispersants

Surfactants are surface active agents which are soluble compounds which reduce the interfacial tension between a liquid and a solid. The thermographic and photothermographic recording materials of the present invention may contain anionic, non-ionic or amphoteric surfactants, with anionic and non-ionic surfactants preferred as disclosed in WO 97/04356. Suitable dispersants are natural polymeric substances, synthetic polymeric substances and finely divided powders, for example finely divided non-metallic inorganic powders such as silica.

Coating

The coating of any layer of the photothermographic recording materials of the present invention may proceed by any coating technique e.g. such as described in Modern Coating and Drying Technology, edited by Edward D. Cohen and Edgar B. Gutoff, (1992) VCH Publishers Inc., 220 East 23rd Street, Suite 909 New York, N.Y. 10010, USA, hereby incorporated by reference.

Process for Preparing a Photothermographic Recording Material

The present invention also provides a process for preparing a photothermographic recording material.

Surprisingly it has been found that by subjecting the photothermographic recording materials, produced according to the above-mentioned process, to temperatures at or above 35° C. in the dark for at least 3 days, there is little or no change in background density Dmin and S-value and moreover that the Dmin- and S-values had been stabilized, as evidenced by the little or no additional change in Dmin- and S-values upon storage in the dark under conditions such as 7 days at 45° C. and 70% relative humidity, which simulate prolonged shelf-life conditions, whether the photothermographic recording material was present as a roll of material or as individual sheets.

In a preferred embodiment of the process for preparing a photothermographic recording material the thermographic recording material is heated at a temperature of at least 35° C. for at least 3 days with a temperature of at least 45° C. being particularly preferred. Furthermore, the temperature is preferably less than 50° C. The period is preferably at least 1 week and the heating is preferably carried out at a relative humidity between 10 and 75% and particularly preferably between 15 and 70%. Especially preferred is heating in the dark for 7 days at 45° C. and 70% relative humidity.

Photothermographic Printing

Photothermographic recording materials, according to the present invention, may be exposed with radiation of wavelength between an X-ray wavelength and a 5 microns wavelength with the image either being obtained by pixel-wise exposure with a finely focused light source, such as a CRT light source; a UV, visible or IR wavelength laser, such as a He/Ne-laser or an IR-laser diode, e.g. emitting at 780 nm, 830 nm or 850 nm; or a light emitting diode, for example one emitting at 659 nm; or by direct exposure to the aspect itself or an image therefrom with appropriate illumination e.g. with UV, visible or IR light. For the thermal development of image-wise exposed photothermographic recording materials, according to the present invention, any sort of heat source can be used that enables the recording materials to be uniformly heated to the development temperature in a time acceptable for the application concerned e.g. contact heating, radiative heating, microwave heating etc.

Industrial Application

Photothermographic recording materials according to the present invention may be used for both the production of transparencies, for example in the medical diagnostic field in which black-imaged transparencies are widely used in inspection techniques operating with a light box, reflection type prints, for example in the hard copy graphics field and in microfilm applications. For such applications the support will be transparent or opaque, i.e. having a white light reflecting aspect. Should a transparent base be used, the base may be colourless or coloured, e.g. with a blue colour for medical diagnostic applications.

The invention is described hereinafter by way of INVENTION EXAMPLES 1 to 38 and COMPARATIVE EXAMPLES 1 to 5 in which all percentages are percentages by weight unless otherwise specified and the following ingredients were used:

Photo-addressable Thermally Developable Element:

AgB = silver behenate

SENSI 01 =

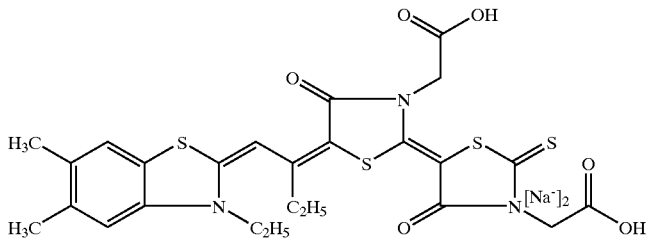

LOWINOX 22IB46 = 2-propyl-bis(2-hydroxy-3,5-dimethylphenyl)methane from CHEM. WERKE LOWI;

R16875 = R16875, a phthaloyl gelatine from ROUSSELOT;

K7598 = type 7598, a calcium-free gelatin from AGFA-GEVAERT GELATINEFABRIEK;

BAYSTAL ™ KA8522 = 50% by weight aqueous dispersion of a latex on the basis of styrene and butadiene from BAYER;

Surfactant Nr. 1 = MARLON A-396, a sodium alkyl-phenylsulfonate from Hüls;

Surfactant Nr. 2 = ERKANTOL ™ BX, a sodium diisopropyl-naphthalenesulfonate from BAYER;

Surfactant Nr. 3 = ULTRAVON ™ W, supplied as a 75–85% concentrate of a sodium arylsulfonate by CIBA-GEIGY;

TA01 = phthalazine;

STABI 01 =

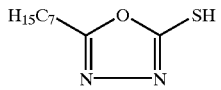

STABI 02 = 4-methyl-phthalic acid; and

-continued

| | | |
|---|---|---|
| STABI 03 | = | phenyl tribromomethyl sulfone. |
| antihalation layer: | | |
| K7598 | = | Type 7598, a calcium-free gelatin from AGFA-GEVAERT GELATINEFABRIEK; |
| LATEX 01 | = | a poly(ethylacrylate) latex; and |
| KIESELSOL 300F | = | a 30% aqueous dispersion of colloidal silica from BAYER. |
| ANTIHALO 01 | | 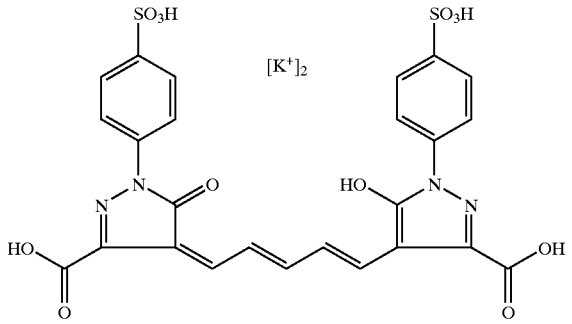 |
| protective layer: | | |
| K7598 | = | Type 7598, a calcium-free gelatin from AGFA-GEVAERT GELATINEFABRIEK; |
| Surfactant Nr. 4 | = | ammonium salt of perfluoro-octanoic acid. |

Preparation of Type 02 Photosensitive Silver Halide

The type 02 silver halide emulsion consisting of 11.44% by weight of silver halide particles consisting of 97 mol % silver bromide and 3 mol % silver iodide with a weight average particle size of 70 nm as measured with the Moeller Teller method (see above for details) and 5.17% by weight of R16875 as dispersing agent in deionized water was prepared using conventional silver halide preparation techniques at 50.5° C. such as described, for example, in T. H. James, "The Theory of the Photographic Process, Fourth Edition, Macmillan Publishing Co. Inc., New York (1977)", Chapter 3, pages 88–104.

Preparation of Types 01 and 03–15 Photosensitive Silver Halide

Types 01 and 03–15 photosensitive silver halide were prepared as described above except as indicated in Table 1 and in the notes referred to therein.

TABLE 1

| | AgX-composition | | | grain size | preparation details: temperature | preparation details: as type 02 |
|---|---|---|---|---|---|---|
| type | at % Br | at % I | dopant(s) | [nm] | [° C.] | except for |
| 01 | 97 | 3 | $Ir^{4+}$ | 68 | 50 | see footnote (a) |
| 03 | 97 | 3 | $Ir^{4+}$ + $Cu^{2+}$ | 69 | 50.5 | see footnote (b) |
| 04 | 97 | 3 | $Ir^{4+}$ + $Fe^{3+}$ | 68 | 50.5 | see footnote (c) |
| 05 | 100 | 0 | $Ir^{4+}$ | 80 | 50 | see footnote (d) |
| 06 | 100 | 0 | — | 73 | 50.5 | different temperature |
| 07 | 100 | 0 | — | 51 | 36 | different temperature |
| 08 | 100 | 0 | — | 57 | 40.5 | different temperature |
| 09 | 100 | 0 | — | 61 | 45.5 | different temperature |
| 10 | 100 | 0 | — | 86 | 52 | different temperature |
| 11 | 100 | 0 | — | 94 | 54 | different temperature |
| 12 | 100 | 0 | — | 101 | 57 | different temperature |
| 13 | 100 | 0 | — | 109 | 60 | different temperature |
| 14 | 100 | 0 | — | 113 | 63 | different temperature |
| 15 | 100 | 0 | — | 135 | 69.5 | different temperature |

(a) a solution of 1 g/L of $K_2IrCl_6.6H_2O$ was additionally added once 90% of the silver nitrate had been added such than the AgX obtained contains $2.10^{-5}$ mol $Ir^{4+}$/mol AgX and the preparation was carried out at the temperature given in table 1;

(b) a solution of 1 g/L of $K_2IrCl_6.6H_2O$ and 1 g/L $Cu(NO_3)_2$ was additionally added once 90% of the silver nitrate had been added such than the AgX obtained contains $2.10^{-5}$ mol $Ir^{4+}$ and $1.10^{-5}$ mol $Cu^{2+}$/mol AgX and the preparation was carried out at the temperature given in table 1;

(c) a solution of 1 g/L of $K_2IrCl_6.6H_2O$ and 1 g/L $Fe(NO_3)_3$ was additionally added once 90% of the silver nitrate had been added such than the AgX obtained contains $2.10^{-5}$ mol $Ir^{4+}$ and $1.10^{-5}$ mol $Fe^{3+}$/mol AgX and the preparation was carried out at the temperature given in table 1;

(d) a solution of 1 g/L of $K_2IrCl_6.6H_2O$ was additionally added once 90% of the silver nitrate had been added such than the AgX obtained contains $2.10^{-5}$ mol $Ir^{4+}$/mol AgX and the preparation was carried out at the temperature given in table 1.

INVENTION EXAMPLES 1 TO 5 & COMPARATIVE EXAMPLE 1

Preparation of Silver Behenate Dispersions in an Aqueous Medium in the Absence of Organic Solvent Using the Single Jet Process Disclosed in EP-A 848 286

The type I aqueous dispersion of silver behenate used in INVENTION EXAMPLES 1 to 5 and COMPARATIVE EXAMPLE 1 was produced as follows:

i) dispersing 136.2 g (0.4M) behenic acid with stirring at 310 rpm with a 80 mm diameter typhoon stirrer in a 200 mm in diameter vessel at 80° C. in a quantity of 0.549 L of a 10% solution of Surfactant nr 1 and 662 g of deionized water at a temperature of 80° C. ;

ii) then adding 0.188 L of a 2M aqueous solution of sodium hydroxide with stirring at 310 rpm with a 80 mm diameter typhoon stirrer to the 200 mm in diameter vessel at 80° C. over a period of 10 minutes to produce a clear solution substantially containing sodium behenate;

iii) then adding a 0.360 L of a 1M aqueous solution of silver nitrate with stirring at 310 rpm With a 80 mm diameter typhoon stirrer to the 200 mm in diameter vessel at a temperature of 80° C. over a period of 4.5 minutes to convert the sodium behenate completely into silver behenate.

The aqueous silver behenate dispersion obtained contained 8.15% by weight of silver behenate and 2.78% by weight of Surfactant 1 and was subsequently desalted and concentrated using ultrafiltration to an aqueous dispersion containing 22.37% by weight of silver behenate.

Preparation of Aqueous Dispersions 26.2 g of K7598 was dissolved in 150 g of deionized water at 40° C. To this gelatin solution 19.35 g of a 11.44% by weight dispersion of silver halide type 1 was then added over a period of 20 s with stirring corresponding to 11.7 mmol of silver halide. Then the quantities of silver nitrate given in Table 2 were added as a 3.56% by weight solution and the resulting dispersion made up to 265.4 g with deionized water while maintaining the temperature at 40° C. After stirring for 1 hour at 40° C. a UAg measurement was carried out (UAg-1) then 206.6 g of the above-described silver behenate dispersion was added together with 2.4 g of 1N nitric acid and after a further 20 minutes stirring at 40° C. a second UAg measurement (UAg-2) was carried out.

After the second UAg measurement the following ingredients were added: 8.7 g of a 4 g/L solution of SENSI 01 followed by 20 minutes stirring, then 11.8 g of a 8% by weight solution in methanol of STABI 01 and finally just before coating 112 g of a dispersion consisting of 4.68% by weight of phthalazine, 16.84% by weight of LOWINOX 22IB46 and 2% by weight of Surfactant Nr. 2.

Preparation of the Photothermographic Recording Materials

An antihalation layer dispersion was prepared by dissolving 62.5 g of K7598 in 1L of deionized water at 40° C. The following ingredients were then added to the resulting gelatin solution: 14.5 g of a 10% by aqueous weight solution of ANTIHALO 01, 8 g of a 10% by weight aqueous dispersion of LATEX 01, 42 g of a 20% by weight aqueous dispersion of KIESELSOL 300F and finally the pH was adjusted to 6 before doctor-blade coating to a wet-layer thickness of 45 μm on one side of a 100 μm poly(ethylene terephthalate) support subbed on both sides and drying at 25° C. for 5 minutes.

A solution for the first layer of the thermosensitive element was then prepared by dissolving 42.5 g of K7598 in 1928.2 g of deionized water at 40° C. and then adding the following ingredients with stirring: 8.7 g of STABI 02, 179.1 g of a STABI 03-dispersion (consisting of 17.5% by weight of STABI 03, 10% by weight of K7598 and 1% by weight of Surfactant Nr. 1), 6 g of 1-phenyl-5-mercapto-tetrazole dissolved in 227.3 g of methanol and 17.4 g of a 10% solution of Surfactant Nr. 3.

The side of the support not coated with the antihalation layer was then coated with the solution for the first layer of the thermosensitive element to a wet layer thickness of 50 μm to produce after drying at 25° C. for 5 minutes the first layer of the thermosensitive element.

The first layer of the thermosensitive element was then overcoated with the above-described aqueous dispersion to a wet layer thickness of 100 μm to form after drying at 25° C. for 5 minutes the second layer of the thermosensitive element.

Finally the second layer of the thermosensitive element was overcoated with a solution of 57 g of K7598 in 2560 g of deionized water to which 78 g of a 5% by weight solution of Surfactant Nr. 4 had been added to a wet layer thickness of 50 μm to form after drying at 25° C. for 5 minutes a protective layer.

Evaluation of the Photothermographic Recording Materials

The photothermographic recording materials of INVENTIVE EXAMPLES 1 to 5 and COMPARATIVE EXAMPLE 1 were first exposed to a He—Ne laser (632.8 nm) through a grey scale wedge to vary the exposure of the film and then heated for 20 s at 100° C. to produce a wedge image. The print density variation in the wedge image was determined with a MACBETH TD903 densitometer with a visual filter giving the dependence of optical density upon exposure. The S-values, defined as the exposure in $mJ/m^2$ at which an optical density of 1.0 above Dmin was achieved, were determined from these optical density-exposure dependencies. The lower the value of exposure, S, required to obtain an optical density of 1.0 above Dmin, the higher the photosensitivity of the photothermographic material.

Photothermographic evaluation was carried out on freshly coated photothermographic recording materials and also after being subjected to one or more of the following tests to determine the changes in background density ΔDmin and in S, ΔS:

i) 1 week in the dark at 20° C. and ca. 45% relative humidity;

ii) 6 weeks in the dark at 20° C. and ca. 45% relative humidity;

iii) 1 week in the dark at 35° C. at ca. 45% relative humidity;

iv) 1 week in the dark at 40° C. at ca. 45% relative humidity;

v) 1 week in the dark at 43° C. at ca. 45% relative humidity;

vi) 1 week in the dark at 45° C. at 15% relative humidity;

vii) 1 week in the dark at 45° C. and 70% relative humidity;

viii) 1 week in the dark at 45° C. and 70% relative humidity followed by 1 week in the dark at 20° C. and ca 45% relative humidity;

ix) 1 week in the dark at 45° C. and 70% relative humidity followed by 5 weeks in the dark at 20° C. and ca. 45% relative humidity;

x) 1 week in the dark at 45° C. and 70% relative humidity followed by 1 week in the dark at 35° C. and 80% relative humidity;

xi) 2 weeks in the dark at 45° C. and 70% relative humidity;

xii) 1 week in the dark at 47° C. at ca. 45% relative humidity,

The results for the photothermographic recording materials of INVENTION EXAMPLES 1 to 5 and COMPARATIVE EXAMPLE 1 are summarized in Table 2 below.

The photothermographic recording materials of INVENTION EXAMPLES 1 to 5 and COMPARATIVE EXAMPLE 1 were all carried out with type 01 silver halide. Addition of silver nitrate as the second silver salt in concentrations between 3.58 mol % (INVENTION EXAMPLE 1) and 44.8 mol % (INVENTION EXAMPLE 5) with respect to silver halide, produced a significant reduction in S-values compared with S-value of 631 mJ/m$^2$ exhibited by the photothermographic recording material of COMPARATIVE EXAMPLE 1 in which no silver nitrate had been added during the preparation of the aqueous dispersion i.e. from 631 to 178–316 mJ/m$^2$, the photothermographic recording materials of INVENTION EXAMPLES 1 to 5 thus requiring a lower exposure to obtain the same density and hence exhibiting significantly higher photosensitivity. Photothermographic recording materials in which silver nitrate quantities between 35 and 45 mol % with respect to silver halide had been added (see INVENTION EXAMPLES 4 and 5) exhibited the lowest S-values (i.e. the highest photosensitivities) and the lowest Dmin values for fresh materials.

S-values in the case of the addition of silver nitrate quantities below 20 mol % with respect to silver halide (see the results for INVENTION EXAMPLES 1 and 2).

INVENTION EXAMPLES 6 TO 24 AND COMPARATIVE EXAMPLE 2

The preparation of the photothermographic recording materials of INVENTION EXAMPLES 6 to 24 and COMPARATIVE EXAMPLE 2 and the preparation of the aqueous dispersions used therein were as described for INVENTION EXAMPLES 1 to 5 and COMPARATIVE EXAMPLE 1 except that different AgX-types were used as given in Table 3 below. The evaluation of the photothermographic recording materials of INVENTION EXAMPLES 6 to 24 and COMPARATIVE EXAMPLE 2 was also carried out as described for INVENTION EXAMPLES 1 to 5 and COMPARATIVE EXAMPLE 1. The results are summarized together with those for INVENTION EXAMPLE 4 in Table 3 below.

The photothermographic recording materials of INVENTION EXAMPLES 10 to 12 and COMPARATIVE EXAMPLE 2 were all carried out with type 06 silver halide. Addition of silver nitrate as the second silver salt in concentrations between 26.8 mol % (INVENTION EXAMPLE 10) and 71.6 mol % (INVENTION EXAMPLE 12) with respect to silver halide, produced a significant reduction in S-values compared with the S-value of 446 mJ/m$^2$ exhibited

TABLE 2

| | AgX-type | mmole $AgNO_3$ added | mol second silver salt/mol AgX | UAg-1 [mV] | UAg-2 [mV] | fresh material Dmin | fresh material S [mJ/m$^2$] | ageing test | after ageing test in dark ΔDmin | after ageing test in dark ΔS [mJ/m$^2$] |
|---|---|---|---|---|---|---|---|---|---|---|
| Invention example nr | | | | | | | | | | |
| 1 | 01 | 0.419 | 0.0358 | 301 | 290 | 0.5 | 316 | i) | +0.41 | +131 |
| | | | | | | | | vii) | −0.19 | −34 |
| 2 | 01 | 2.10 | 0.179 | 403 | 354 | 0.36 | 224 | i) | +0.78 | +407 |
| | | | | | | | | vii) | −0.06 | 0 |
| | | | | | | | | viii) | −0.05 | +27 |
| | | | | | | | | xi) | −0.05 | +78 |
| 3 | 01 | 3.14 | 0.268 | 432 | 371 | 0.35 | 200 | i) | +0.33 | +51 |
| | | | | | | | | vii) | −0.06 | +24 |
| | | | | | | | | viii) | −0.06 | +51 |
| | | | | | | | | xi) | −0.06 | 0 |
| 4 | 01 | 4.19 | 0.358 | 447 | 423 | 0.34 | 178 | i) | +0.42 | +46 |
| | | | | | | | | vii) | −0.05 | +46 |
| | | | | | | | | viii) | −0.05 | +46 |
| | | | | | | | | xi) | −0.05 | +22 |
| 5 | 01 | 5.24 | 0.448 | 458 | .425 | 0.36 | 178 | i) | +0.45 | +46 |
| | | | | | | | | vii) | −0.08 | +73 |
| | | | | | | | | viii) | −0.08 | +73 |
| | | | | | | | | xi) | −0.05 | +73 |
| Comparative example nr | | | | | | | | | | |
| 1 | 01 | 0 | 0 | 124 | 273 | 0.37 | 631 | i) | +0.26 | +260 |
| | | | | | | | | vii) | −0.07 | +260 |
| | | | | | | | | viii) | −0.07 | +77 |
| | | | | | | | | xi) | −0.04 | 0 |

From the ageing tests in the dark, it is clear that stabilization of Dmin was achieved by prolonged conditioning at temperatures above 35° C. for the photothermographic recording materials of both the INVENTION and COMPARATIVE EXAMPLES and a significantly reduced drift in by the photothermographic recording material of COMPARATIVE EXAMPLE 2 in which no silver nitrate had been added during the preparation of the aqueous dispersion i.e. from 446 to 79–178 mJ/m$^2$, the photothermographic recording materials of INVENTION EXAMPLES 10 to 12 requiring a lower exposure to obtain the same density and hence exhibiting significantly higher photosensitivities.

From the ageing tests in the dark, it is clear that stabilization of Dmin was also achieved by prolonged conditioning at temperatures above 35° C. for both the photothermographic materials of INVENTION EXAMPLE 11 and COMPARATIVE EXAMPLE 2 using type 06 silver halide.

the lowest Dmin-values were found for photothermographic recording materials with silver bromides with grain sizes between 50 and 95 nm. Photothermographic recording materials with silver iodobromide doped with $Ir^{4+}$ optionally with $Cu^{2+}$ or $Fe^{3+}$ for a similar grain size exhibited similar photosensitivities, but with a significantly lower Dmin (see the results for INVENTION EXAMPLES 4 and 6 to 8).

TABLE 3

| | AgX-type | mmole $AgNO_3$ added | mol second silver salt/mol AgX | UAg-1 [mV] | UAg-2 [mV] | fresh material Dmin | fresh material S [mJ/m²] | ageing test | after ageing test in dark ΔDmin | after ageing test in dark ΔS [mJ/m²] |
|---|---|---|---|---|---|---|---|---|---|---|
| Invention example nr | | | | | | | | | | |
| 4 | 01 | 4.19 | 0.358 | 447 | 423 | 0.34 | 178 | i) | +0.42 | +46 |
| | | | | | | | | vii) | −0.05 | +46 |
| | | | | | | | | viii) | −0.05 | +46 |
| | | | | | | | | xi) | −0.05 | +22 |
| 6 | 02 | 4.19 | 0.358 | 450 | 421 | 0.30 | 148 | vii) | −0.01 | +42 |
| | | | | | | | | viii) | −0.01 | +42 |
| | | | | | | | | xi) | +0.01 | +65 |
| 7 | 03 | 4.19 | 0.358 | 445 | — | 0.30 | 148 | vii) | −0.01 | +65 |
| | | | | | | | | viii) | −0.01 | +51 |
| | | | | | | | | xi) | +0.01 | +83 |
| 8 | 04 | 4.19 | 0.358 | 446 | 421 | 0.32 | 158 | vii) | −0.03 | +65 |
| | | | | | | | | viii) | −0.03 | +41 |
| | | | | | | | | xi) | 0 | +87 |
| 9 | 05 | 4.19 | 0.358 | 446 | — | 0.36 | 126 | vii) | −0.05 | +15 |
| | | | | | | | | viii) | −0.06 | +51 |
| | | | | | | | | xi) | −0.04 | +64 |
| 10 | 06 | 3.14 | 0.268 | 434 | 368 | 0.36 | 79 | | | |
| 11 | 06 | 4.19 | 0.358 | 448 | 407 | 0.33 | 95 | i) | +0.64 | +46 |
| | | | | | | | | vii) | −0.01 | −2 |
| | | | | | | | | viii) | −0.02 | +5 |
| | | | | | | | | xi) | 0 | +46 |
| 12 | 06 | 8.38 | 0.716 | 477 | 448 | 0.48 | 178 | | | |
| 13 | 07 | 4.19 | 0.358 | 439 | — | 0.41 | 263 | | | |
| 14 | 08 | 4.19 | 0.358 | 437 | — | 0.38 | 251 | | | |
| 15 | 09 | 4.19 | 0.358 | 440 | — | 0.36 | 200 | | | |
| 16 | 10 | 4.19 | 0.358 | 441 | — | 0.44 | 76 | | | |
| 17 | 11 | 4.19 | 0.358 | — | 428 | 0.42 | 100 | | | |
| 18 | 12 | 4.19 | 0.358 | — | 426 | 0.43 | 79 | | | |
| 19 | 13 | 4.19 | 0.358 | — | 425 | 0.46 | 79 | | | |
| 20 | 14 | 4.19 | 0.358 | — | 425 | 0.47 | 60 | | | |
| 21* | 14 | 4.19 | 0.179 | — | 424 | 0.69 | 63 | | | |
| 22# | 14 | 4.19 | 0.179 | — | 424 | 0.56 | 56 | | | |
| 23 | 15 | 4.19 | 0.358 | 440 | — | 0.60 | 224 | | | |
| 24 | 1:1 9 + 10 | 4.19 | 0.358 | — | 420 | 0.38 | 158 | | | |
| Comparative example nr | | | | | | | | | | |
| 2 | 06 | 0 | 0 | — | 299 | 0.35 | 446 | i) | +0.91 | +509 |
| | | | | | | | | vii) | −0.04 | +116 |
| | | | | | | | | viii) | −0.04 | +509 |

*= doubling of quantity of AgX and SENSI 01 used
#= doubling of quantity of AgX used In the preparation of the aqueous dispersions used in preparing the photothermographic recording materials of INVENTION EXAMPLES 4, 6 to 9, 11, 13 to 20 and 23, 35.8 mol % of silver nitrate with respect to silver halide was added to silver halide types 01 to 14 respectively. The S-values attained with these photothermographic recording materials were found to be dependent upon the type of silver halide used. With pure silver bromide grains both the S-value and Dmin were found to depend strongly upon grain size with the lowest S-values i.e. highest photosensitivities found for photothermographic recording materials with silver bromides with grain sizes between 70 and 120 nm and

INVENTION EXAMPLES 25 TO 29

The preparation of the photothermographic recording materials of INVENTION EXAMPLES 25 to 29 and the preparation of the aqueous dispersions used therein were as described for INVENTION EXAMPLES 1 to 5 and COMPARATIVE EXAMPLE 1 except that silver nitrate was replaced by other water-soluble silver salts e.g. silver acetate, silver sulphate and silver lactate. The details of the preparation of the aqueous dispersions used are given in Table 4 below.

TABLE 4

| Invention example nr | AgX type | second silver salt which ? | mmole added | mol second silver salt/mol AgX | UAg-1 [mV] | UAg-2 [mV] | fresh material Dmin | fresh material S [mJ/m²] | ageing test | after ageing test in dark ΔDmin | after ageing test in dark ΔS [mJ/m²] |
|---|---|---|---|---|---|---|---|---|---|---|---|
| 11 | 06 | $AgNO_3$ | 4.19 | 0.358 | 448 | 407 | 0.33 | 95 | i) | +0.64 | +46 |
| | | | | | | | | | vii) | −0.01 | −2 |
| | | | | | | | | | viii) | −0.02 | +5 |
| | | | | | | | | | xi) | 0 | +46 |
| 18 | 12 | $AgNO_3$ | 4.19 | 0.358 | — | 426 | 0.43 | 79 | | | |
| 25 | 06 | * | 4.19 | 0.358 | — | 420 | 0.39 | 71 | | | |
| 26 | 12 | * | 4.19 | 0.358 | — | 428 | 0.40 | 79 | | | |
| 27 | 06 | $Ag_2SO_4$ | 4.19 | 0.358 | — | 422 | 0.38 | 91 | | | |
| 28 | 06 | # | 4.19 | 0.358 | — | 413 | 0.67 | 240 | i) | +0.19 | −16 |
| | | | | | | | | | vii) | −0.31 | −40 |
| 29 | 06 | # | 6.42 | 0.548 | — | 440 | 0.69 | 126 | (i) | +0.22 | −14 |
| | | | | | | | | | vii) | −0.34 | +74 |

*silver acetate
#silver lactate

The evaluation of the photothermographic recording materials of INVENTION EXAMPLES 25 to 29 was carried out as described for INVENTION EXAMPLES 1 to 5 and COMPARATIVE EXAMPLE 1. The results are summarized together with those for INVENTION EXAMPLE 4 in Table 4 below together with those for INVENTION EXAMPLES 11 and 18 in which silver halide types 06 and 12 had been used and the same molar quantity of silver nitrate as the second silver salt was used. Preparation of the aqueous dispersion used in the preparation of the photothermographic recording materials of INVENTION EXAMPLES 25 to 29 with silver sulphate, silver acetate or silver lactate as the second silver salt instead of silver nitrate also resulted in photothermographic recording materials with a significant improvement in photosensitivity and improved stability in ageing tests over aqueous dispersions in which no second silver salt had been added. In the cases of silver acetate, silver sulphate and silver nitrate identical effects within experimental error were observed at identical molarities with respect to silver halide (see INVENTION EXAMPLES 25 to 28), whereas in the case of silver lactate a higher molar concentration with respect to silver halide appeared to be necessary (see INVENTION EXAMPLE 29). This shows that the present invention is not restricted in its scope to a particular second silver salt, but that any soluble silver salt can be used.

INVENTION EXAMPLE 30 AND COMPARATIVE EXAMPLE 3

The preparation of the photothermographic recording materials of INVENTION EXAMPLE 30 and COMPARATIVE EXAMPLE 3 and the preparation of the aqueous dispersions used therein were as described for INVENTION EXAMPLES 1 to 5 and COMPARATIVE EXAMPLE 1 except that 6.5 g of BAYSTAL™ KA8522 was added to the aqueous solution of K7598 gelatin. The details of the preparations of the aqueous dispersions used are given in Table 5 below.

The evaluation of the photothermographic recording materials of INVENTION EXAMPLE 30 and COMPARATIVE EXAMPLE 3 was carried out as described for INVENTION EXAMPLES 1 to 5 and COMPARATIVE EXAMPLE 1. The results are summarized in Table 5 below together with those for INVENTION EXAMPLE 11 in which only gelatin had been used.

TABLE 5

| | AgX-type | mmole $AgNO_3$ added | mol second silver salt/mol AgX | UAg-1 [mV] | UAg-2 [mV] | fresh material Dmin | fresh material S [mJ/m²] | ageing test | after ageing test in dark ΔDmin | after ageing test in dark ΔS [mJ/m²] |
|---|---|---|---|---|---|---|---|---|---|---|
| Invention example nr | | | | | | | | | | |
| 11 | 06 | 4.19 | 0.358 | 448 | 407 | 0.33 | 95 | i) | +0.64 | +46 |
| | | | | | | | | vii) | −0.01 | 2 |
| | | | | | | | | viii) | −0.02 | +5 |
| | | | | | | | | xi) | 0 | +46 |
| 30 | 06 | 4.19 | 0.358 | — | 411 | 0.74 | 200 | i) | +0.18 | −42 |
| | | | | | | | | vii) | −0.15 | −59 |
| Comparative example nr. | | | | | | | | | | |
| 3 | 06 | 0 | 0 | — | 290 | 0.43 | 794 | i) | +0.21 | +586 |
| | | | | | | | | (vii) | +0.04 | +495 |

In the aqueous dispersion of INVENTION EXAMPLE 30, BAYSTAL™ KA8522 was used as a binder in addition to gelatin. The photothermographic recording material prepared therewith exhibited the same photosensitivity improvement and improved stability in ageing tests observed with the photothermographic recording materials of INVENTION EXAMPLES 10 to 12 with the same silver halide type. Therefore, the improvements in photosensitivity and stability achieved with the present invention were not affected by the choice of binder.

INVENTION EXAMPLE 31

The preparation of the photothermographic recording materials of INVENTION EXAMPLE 31 and the preparation of the aqueous dispersion used therein was as described for INVENTION EXAMPLES 1 to 5 and COMPARATIVE EXAMPLE 1 except that the first silver salt, silver behenate, was replaced with silver stearate. The details of the preparations of the aqueous dispersion used are given in Table 6 below.

The evaluation of the photothermographic recording materials of INVENTION EXAMPLE 31 was carried out as described for INVENTION EXAMPLES 1 to 5 and COMPARATIVE EXAMPLE 1. The results are summarized in Table 6 below together with those for INVENTION EXAMPLE 11 in which a silver behenate dispersion had been used.

TABLE 6

| Invention example nr | AgX-type | mmole $AgNO_3$ added | mol second silver salt/mol AgX | UAg-1 [mV] | UAg-2 [mV] | fresh material Dmin | fresh material S [mJ/m²] | ageing test | after ageing test in dark ΔDmin | after ageing test in dark ΔS [mJ/m²] |
|---|---|---|---|---|---|---|---|---|---|---|
| 11 | 06 | 4.19 | 0.358 | 448 | 407 | 0.33 | 95 | i) | +0.64 | +46 |
| | | | | | | | | vii) | −0.01 | −2 |
| | | | | | | | | viii) | −0.02 | +5 |
| | | | | | | | | xi) | 0 | +46 |
| 31 | 06 | 4.19 | 0.358 | — | 421 | 1.08 | 89 | viii) | −0.66 | +23 |

Preparation of the aqueous dispersion of INVENTION EXAMPLE 31 with silver stearate instead of silver behenate as the first silver salt resulted in a photothermographic recording material with a comparable improvement in photosensitivity and stability in ageing tests to that observed with the photothermographic recording material of INVENTION EXAMPLE 11 in which silver behenate was used as the first silver salt and the same silver halide type had been used. Therefore, the improvement in photosensitivity and stability is not restricted to a particular first silver salt, but is obtained for organic silver salts in general.

INVENTION EXAMPLES 32 TO 35 AND COMPARATIVE EXAMPLES 4 AND 5

The preparation of the photothermographic recording materials of INVENTION EXAMPLES 32 to 35 and COMPARATIVE EXAMPLES 4 and 5 and the preparation of the aqueous dispersions used therein were as described for INVENTION EXAMPLES 1 to 5 and COMPARATIVE EXAMPLE 1 except that ammonia was added as a 2.5% by weight aqueous solution before, together with or after the silver nitrate solution and that type 06 silver halide was used in these EXAMPLES. The details of the preparations of the aqueous dispersion used are given in Table 7 together with those of the aqueous dispersion used in preparing the photothermographic recording material of INVENTION EXAMPLE 11 which also was prepared with type 06 silver halide.

TABLE 7

| | mmole $AgNO_3$ added | mol second silver salt/mol AgX | $NH_3$ added as aq. solution when? | quantity [mmoles] | moles/mol AgX | UAg-1 [mV] | pH-1 | UAg-2 [mV] | pH-2 |
|---|---|---|---|---|---|---|---|---|---|
| Invention Example nr | | | | | | | | | |
| 11 | 4.19 | 0.358 | — | — | — | 448 | — | 407 | — |
| 32 | 4.19 | 0.358 | with $AgNO_3$ | 22.1 | 1.889 | 245 | 9.0 | 284 | 8.16 |
| 33 | 4.19 | 0.358 | with $AgNO_3$ | 14.7 | 1.256 | 314 | 8.26 | 357 | 7.27 |
| 34 | 4.19 | 0.358 | after $AgNO_3$* | 14.7 | 1.256 | 325 | 8.18 | 363 | 7.23 |
| 35 | 4.19 | 0.358 | before $AgNO_3$# | 14.7 | 1.256 | 330 | 8.16 | 363 | 7.2 |
| Comparative example nr | | | | | | | | | |
| 4 | 0 | 0 | | 14.7 | 1.256 | 73 | 9.0 | 160 | 8.16 |
| 5 | 0 | 0 | | 22.1 | 1.889 | 67 | 9.2 | 143 | 8.62 |

*after 30 min stirring after $AgNO_3$ addition
#after 30 min stirring after ammonia addition The evaluation of the photothermographic recording materials of INVENTION EXAMPLE 32 to 35 and COMPARATIVE EXAMPLES 4 and 5 was carried out as described for INVENTION EXAMPLES 1 to 5 and COMPARATIVE EXAMPLE 1. The results are summarized in Table 8 below together with those for the photothermographic recording material of INVENTION EXAMPLE 11.

TABLE 8

| | fresh material | | ageing | after ageing tests in the dark | |
|---|---|---|---|---|---|
| | Dmin | S [mJ/m$^2$] | test | ΔDmin | ΔS [mJ/m$^2$] |
| Invention example nr | | | | | |
| 11 | 0.33 | 95 | i) | +0.64 | +46 |
| | | | vii) | −0.01 | −2 |
| | | | viii) | −0.02 | +5 |
| | | | xi) | 0 | +46 |
| 32 | 0.49 | 100 | (i) | +0.16 | +41 |
| | | | (vii) | −0.09 | +58 |
| 33 | 0.68 | 79 | (i) | +0.07 | +33 |
| | | | (vii) | −0.32 | +47 |
| 34 | 0.69 | 89 | (i) | +0.08 | +23 |
| | | | (vii) | −0.34 | +37 |
| 35 | 0.69 | 89 | (i) | +0.15 | +23 |
| | | | (vii) | −0.34 | +37 |
| Comparative example nr. | | | | | |
| 4 | 0.37 | 501 | (i) | +0.15 | 0 |
| | | | (vii) | −0.03 | +848 |
| 5 | 0.46 | 1000 | (i) | +0.13 | +349 |
| | | | (vii) | +0.03 | +349 |

The addition of ammonia in quantities of 1.256 to 1.889 moles/mol silver halide as an aqueous solution to the aqueous dispersion in addition to the second silver salt, according to a preferred embodiment of the present invention, resulted in photothermographic recording materials with a considerable improvement in Dmin stability, with ΔDmin values of +0.07 to +0.16 in ageing test (i): 1 week in the dark at room temperature and a relative humidity of ca. 45%, compared with +0.64 for the photothermographic recording material of INVENTION EXAMPLE 11, coupled with a considerable decrease in S-value i.e. a considerable increase in photosensitivity, although at the expense of a marginal increase in Dmin. This stabilization in ageing test (i) was also found for the photothermographic recording materials of COMPARATIVE EXAMPLES 4 and 5, but the S-values of 501 and 1000 mJ/m$^2$ were considerably higher than those for the photothermographic recording materials of INVENTION EXAMPLES 32 to 35. Whether the aqueous solution of ammonia was added with the second silver salt as in INVENTION EXAMPLE 33, after the addition of the second silver salt as in INVENTION EXAMPLE 34 or before the addition of the second silver salt as in INVENTION EXAMPLE 35, this was found to have no influence upon the imaging performance of the resulting photothermographic recording materials (see the results in Table 8).

INVENTION EXAMPLE 36

The photothermographic recording material of INVENTION EXAMPLE 36 was produced as described for INVENTION EXAMPLE 4, details being given in Table 9. Photothermographic evaluation was carried out as described above for INVENTION EXAMPLES 1 to 5 and COMPARATIVE EXAMPLE 1 and also after they were subjected to different ageing regimes to determine the changes in background density ΔDmin and in S, ΔS. The Dmin and S-values for the fresh photothermographic recording materials C and D are also given Table 9.

TABLE 9

| Invention example nr. | AgX-type | mmoles $AgNO_3$ added | mol second silver salt/mol AgX | UAg-1 [mV] | UAg-2 [mV] | fresh material Dmin | S [mJ/m$^2$] |
|---|---|---|---|---|---|---|---|
| 36 | 01 | 4.19 | 0.358 | 448 | 407 | 0.33 | 95 |

The ΔDmin and ΔS-values after the different ageing regimes with respect to the Dmin- and S-values of the fresh photothermographic recording materials are given in Table 10.

TABLE 10

| Invention example nr | fresh material Dmin | S [mJ/m$^2$] | Ageing regime nr. | temp [° C.] | Period [d] | RH [%] | after ageing in dark ΔDmin | ΔS [mJ/m$^2$] |
|---|---|---|---|---|---|---|---|---|
| 36 | 0.33 | 95 | i) | 20 | 7 | 45 | +0.64 | +46 |
| | | | ii) | 20 | 42 | 45 | +1.59 | >+1000 |
| | | | iii) | 35 | 7 | ca. 45 | +0.05 | +40 |
| | | | iv) | 40 | 7 | ca. 45 | +0.04 | +25 |
| | | | v) | 43 | 7 | ca. 45 | +0.04 | +31 |
| | | | xii) | 47 | 7 | ca. 45 | +0.06 | +40 |
| | | | vi) | 45 | 7 | 15 | +0.01 | +12 |
| | | | vii) | 45 | 7 | 70 | −0.01 | −2 |
| | | | viii) | 45/20 | 7/7 | 70/45 | −0.02 | +5 |
| | | | ix) | 45/20 | 7/35 | 70/45 | +0.07 | −15 |
| | | | x) | 45/35 | 7/7 | 70/80 | 0.0 | +5 |

Ageing regimes i) and ii) showed that no stabilization of Dmin was achieved after subjection for 7 days in the dark at 20° C. and 45% relative humidity in ageing test i), despite an increase of 0.64 in Dmin, as evidenced by the further 0.95 increase in Dmin upon a further 35 days in the dark at 20° C. and ca. 45% relative humidity [ageing test ii)].

On the other hand subjection of photothermographic recording material of INVENTION EXAMPLE 36 to 7 days in the dark at 45° C. and 70% relative humidity resulted in no significant change in Dmin or the S-value [see ageing test vii)]. Furthermore, ageing regimes viii) ix) and x) all represented further ageing in addition to ageing regime vii)

representing an additional 7 days in the dark at 20° C. and 45% relative humidity, an additional 35 days in the dark at 20° C. and 45% relative humidity and an additional 7 days in the dark at 35° C. and 80% relative humidity respectively. In none of these cases was a significant further variation in Dmin or S-value observed, despite ageing test x) representing a simulation of prolonged shelf-life. This indicated stabilization of both Dmin and S-values after the initial 7 days heat treatment in the dark at 45° C. and 70% relative humidity.

In ageing tests (iii) to (v) and (xii) the photothermographic recording material of INVENTION EXAMPLE 36 was subjected to 7 days heating in the dark at ca. 45% relative humidity at temperatures between 35 and 47° C. In all cases no significant variation in Dmin was observed.

In ageing test vi) the photothermographic recording material D of INVENTION EXAMPLE 36 was subjected 7 days heating in the dark at 45° C. and 15% relative humidity. Again no significant variation in Dmin was observed.

INVENTION EXAMPLES 37 AND 38

The photothermographic recording materials of INVENTION EXAMPLES 37 and 38 were produced as described for INVENTION EXAMPLE 11 except that the aqueous emulsions were prepared by mixing the same quantities of ingredients in a different order.

The preparation of the aqueous emulsion of INVENTION EXAMPLE 37 differed from that of INVENTION EXAMPLE 11 in that the silver halide dispersion was mixed with the silver behenate dispersion before the 4.19 mmol $AgNO_3$ was added and the nitric acid was not added simultaneously with the silver behenate dispersion, but after the addition of the silver nitrate. The UAg was determined after the nitric acid was added to be 417 mV, which is similar to the Uag-2 value found for INVENTION EXAMPLE 11.

The preparation of the aqueous emulsion of INVENTION EXAMPLE 38 differed from that of INVENTION EXAMPLE 11 in that the silver nitrate solution was not added before the addition of silver behenate dispersion, but after the addition of the solution of STABI 01 in methanol. The UAg was determined after mixing the silver halide, silver behenate and nitric acid to be 291 mV.

Thus the aqueous emulsions of INVENTION EXAMPLES 37 and 38 are both produced by adding the silver nitrate solution after mixing the silver halide and silver behenate dispersions.

Photothermographic evaluation was carried out as described above for INVENTION EXAMPLES 1 to 5 and COMPARATIVE EXAMPLE 1. The results are summarized in Table 11, the results for INVENTION EXAMPLE 11 being included for the sake of comparison.

The results in Table 11 show that the photothermographic performance of the photothermographic recording materials is comparable whether the silver behenate dispersion is added to a mixture of silver halide dispersion and silver nitrate or whether the silver nitrate solution is added to a mixture of silver halide and silver behenate dispersions.

Having described in detail preferred embodiments of the current invention, it will now be apparent to those skilled in the art that numerous modifications can be made therein without departing from the scope of the invention as defined in the following claims

What is claimed is:

1. A process for producing an aqueous dispersion comprising in the following order the steps of:

(i) preparing a dispersion of photosensitive silver halide and a binder in an aqueous medium or preparing a dispersion of photosensitive silver halide and a surfactant in an aqueous medium;

(ii) adding a first silver salt to the dispersion prepared in step (i); and (iii) adding a second silver salt to the dispersion prepared in step (ii), wherein said aqueous dispersion is substantially free of a water-soluble metal or ammonium salt of an aliphatic carboxylic acid with greater than 12 carbon atoms, said first silver salt is a substantially light-insensitive and substantially water-insoluble silver salt of an organic carboxylic acid, and said second silver salt has a water-solubility greater than 0.1 g in 1 L of water at 20° C.

2. Process according to claim 1, wherein said second silver salt is selected from the group consisting of silver nitrate, silver acetate, silver lactate and silver sulphate.

3. Process according to claim 1, wherein said first silver salt is a silver salt of an aliphatic carboxylic acid with greater than 12 carbon atoms.

4. Process according to claim 1, wherein said second silver salt is present in a concentration of at least 15 mol % with respect to said photosensitive silver halide.

5. A process for producing an aqueous dispersion comprising in the following order the steps of:

(i) preparing a dispersion of photosensitive silver halide and a binder in an aqueous medium or preparing a dispersion of photosensitive silver halide and a surfactant in an aqueous medium;

(ii) adding a second silver salt to the dispersion prepared in step (i); and (iii) adding a first silver salt to the dispersion prepared in step (ii), wherein said aqueous dispersion is substantially free of a water-soluble metal or ammonium salt of an aliphatic carboxylic acid with greater than 12 carbon atoms, said first silver salt is a substantially light-insensitive and substantially water-insoluble silver salt of an organic carboxylic acid, and said second silver

TABLE 11

| Invention example | AgX- | mmoles $AgNO_3$ | mol second silver | UAg-1 | UAg-2 | fresh material | |
|---|---|---|---|---|---|---|---|
| nr. | type | added | salt/mol AgX | [mV] | [mV] | Dmin | S [mJ /m$^2$] |
| 11 | 06 | 4.19 | 0.358 | 448 | 407 | 0.33 | 95 |
| 37 | 06 | 4.19 | 0.358 | — | — | 0.38 | 81 |
| 38 | 06 | 4.19 | 0.358 | — | — | 0.31 | 89 |

salt has a water-solubility greater than 0.1 g in 1 L of water at 20° C.

6. Process according to claim 5, wherein the UAg increases between step (i) and step (ii), UAg being the potential difference between a silver electrode (of ≧99.99% purity) in the aqueous liquid and a reference electrode consisting of a Ag/AgCl-electrode in 3M KCl solution at room temperature connected with the liquid via a salt bridge consisting of a 10% $KNO_3$ salt solution.

7. Process according to claim 5, wherein the UAg decreases between step (ii) and step (iii), UAg being the potential difference between a silver electrode (of ≧99.99% purity) in the aqueous liquid and a reference electrode consisting of a Ag/AgCl-electrode in 3M KCl solution at room temperature connected with the liquid via a salt bridge consisting of a 10% $KNO_3$ salt solution.

8. Process according to claim 5, wherein said second silver salt is selected from the group consisting of silver nitrate, silver acetate, silver lactate and silver sulphate.

9. Process according to claim 5, wherein said first silver salt is a silver salt of an aliphatic carboxylic acid with greater than 12 carbon atoms.

10. Process according to claim 5, wherein said second silver salt is present in a concentration of at least 15 mol % with respect to said photosensitive silver halide.

11. An aqueous dispersion obtainable by a process for producing an aqueous dispersion comprising in the following order the steps of:

(i) preparing a dispersion of photosensitive silver halide and a binder in an aqueous medium or preparing a dispersion of photosensitive silver halide and a surfactant in an aqueous medium;

(ii) adding a first silver salt to the dispersion prepared in step (i); and (iii) adding a second silver salt to the dispersion prepared in step (ii), wherein said aqueous dispersion is substantially free of a water-soluble metal or ammonium salt of an aliphatic carboxylic acid with greater than 12 carbon atoms, said first silver salt is a substantially light-insensitive and substantially water-insoluble silver salt of an organic carboxylic acid, and said second silver salt has a water-solubility greater than 0.1 g in 1 L of water at 200° C.

12. Aqueous dispersion according to claim 11, wherein said second silver salt is present in a concentration of at least 1 mol % with respect to said photosensitive silver halide.

13. Aqueous dispersion according to claim 11, wherein said aqueous dispersion further contains a reducing agent for said first silver salt.

14. Aqueous dispersion according to claim 11, wherein said second silver salt is present in a concentration of at least 15 mol % with respect to said photosensitive silver halide.

15. A process for increasing the sensitivity of a photothermographic recording material thermally developable under substantially water-free conditions, said photothermographic recording material having a photo-addressable thermally developable element, said photo-addressable thermally developable element containing a first silver salt, a reducing agent therefor in thermal working relationship therewith and a binder, comprising:

(i) coating a support with an aqueous dispersion containing said photosensitive silver halide, said first silver salt and a second silver salt with a water-solubility greater than 0.1 g/L water at 200° C. ; and (ii) drying said coating, wherein said aqueous dispersion is substantially free of a water-soluble metal or ammonium salt of an aliphatic carboxylic acid with greater than 12 carbon atoms and said first silver salt is a substantially light-insensitive and substantially water-insoluble silver salt of an organic carboxylic acid.

16. A photothermographic recording material thermally developable under substantially water-free conditions, said photothermographic recording material comprising a support and a photo-addressable thermally developable element, said photo-addressable thermally developable element fulfilling two requirements:

(I) said photo-addressable thermally developable element contains a first silver salt, a reducing agent therefor in thermal working relationship therewith, a photosensitive silver halide and a binder; and (II) said photo-addressable thermally developable element comprises a layer obtainable by coating an aqueous dispersion obtainable by a process for producing an aqueous dispersion comprising in the following order the steps of:

(i) preparing a dispersion of photosensitive silver halide and a binder in an aqueous medium or preparing a dispersion of photosensitive silver halide and a surfactant in an aqueous medium;

(ii) adding a first silver salt to the dispersion prepared in step (i); and (iii) adding a second silver salt to the dispersion prepared in step (ii), wherein said aqueous dispersion is substantially free of a water metal or ammonium salt of an aliphatic carboxylic acid with greater than 12 carbon atoms, said first silver salt is a substantially light-insensitive and substantially water-insoluble silver salt of an organic carboxylic acid, and said second silver salt has a water-solubility greater than 0.1 g in 1 L of water at 20° C. onto said support.

17. A process for preparing a photothermographic recording material, the photothermographic recording material thermally developable under substantially water-free conditions, said photothermographic recording material comprising a support and a photo-addressable thermally developable element and the photo-addressable thermally developable element containing a photosensitive silver halide, a first silver salt, a reducing agent therefor in thermal working relationship therewith and a binder, comprising the steps of:

(I) coating an aqueous dispersion obtainable by a process for producing an aqueous dispersion comprising in the following order the steps of:

(i) preparing a dispersion of photosensitive silver halide and a binder in an aqueous medium or preparing a dispersion of photosensitive silver halide and a surfactant in an aqueous medium;

(ii) adding a first silver salt to the dispersion prepared in step (i); and (iii) adding a second silver salt to the dispersion prepared in wherein said aqueous dispersion is substantially free of a water-soluble metal or ammonium salt of an aliphatic carboxylic acid with greater than 12 carbon atoms, said first silver salt is a substantially light-insensitive and substantially water-insoluble silver salt of an organic carboxylic acid, and said second silver salt has a water-solubility greater than 0.1 g in 1 L of water at 20° C. onto a support; and (II) drying the layer formed in step (I).

18. A photothermographic recording material thermally developable under substantially water-free conditions, said photothermographic recording material comprising a support and a photo-addressable thermally developable element, said photo-addressable thermally developable element fulfilling two requirements:

(I) said photo-addressable thermally developable element contains a first silver salt that is a substantially light-insensitive and substantially water-insoluble silver salt of an organic carboxylic acid, a reducing agent therefor in thermal working relationship therewith, a photosensitive silver halide and a binder; and (II) said photo-addressable thermally developable element comprises a layer obtainable by coating an aqueous dispersion obtainable by a process for producing an aqueous dispersion comprising in the following order the steps of:

(i) preparing a dispersion of photosensitive silver halide and a binder in an aqueous medium or preparing a dispersion of photosensitive silver halide and a surfactant in an aqueous medium;

(ii) adding a second silver salt to the dispersion prepared in step (i); and (iii) adding a first silver salt to the dispersion prepared in step (ii), wherein said aqueous dispersion is substantially free of a water-soluble metal or ammonium salt of an aliphatic carboxylic acid with greater than 12 carbon atoms, said first silver salt is a substantially light-insensitive and substantially water-insoluble silver salt of an organic carboxylic acid, and said second silver salt has a water-solubility greater than 0.1 g in 1 L of water at 20° C. onto said support.

19. Aqueous dispersion according to claim 18, wherein said second silver salt is present in a concentration of at least 1 mol % with respect to said photosensitive silver halide.

20. A process for preparing a photothermographic recording material, the photothermographic recording material thermally developable under substantially water-free conditions, said photothermographic recording material comprising a support and a photo-addressable thermally developable element and the photo-addressable thermally developable element containing a photosensitive silver halide, a first silver salt, a reducing agent therefor in thermal working relationship therewith and a binder, comprising the steps of:

(I) coating an aqueous dispersion obtainable by a process for producing an aqueous dispersion comprising in the following order the steps of:

(i) preparing a dispersion of photosensitive silver halide and a binder in an aqueous medium or preparing a dispersion of photosensitive silver halide and a surfactant in an aqueous medium;

(ii) adding a second silver salt to the dispersion prepared in step (i); and (iii) adding a first silver salt to the dispersion prepared in step (ii), wherein said aqueous dispersion is substantially free of a water-soluble metal or ammonium salt of an aliphatic carboxylic acid with greater than 12 carbon atoms, said first silver salt is a substantially light-insensitive and substantially water-insoluble silver salt of an organic carboxylic acid, and said second silver salt has a water-solubility greater than 0.1 g in 1 L of water at 20° C. onto a support; and (II) drying the layer formed in step (I).

21. An aqueous dispersion obtainable by a process for producing aqueous dispersion comprising in the following order the steps of:

(i) preparing a dispersion of photosensitive silver halide and a binder in an aqueous medium or preparing a dispersion of photosensitive silver halide and a surfactant in an aqueous medium;

(ii) adding a second silver salt to the dispersion prepared in step (i); and (iii) adding a first silver salt to the dispersion prepared in step (ii), wherein said aqueous dispersion is substantially free of a water-soluble metal or ammonium salt of an aliphatic carboxylic acid with greater than 12 carbon atoms, said first silver salt is a substantially light-insensitive and substantially water-insoluble silver salt of an organic carboxylic acid, and said second silver salt has a water-solubility greater than 0.1 g in 1 L of water at 20° C.

22. Aqueous dispersion according to claim 18, wherein said aqueous dispersion further contains a reducing agent for said first silver salt.

23. Aqueous dispersion according to claim 18, wherein said second silver salt is present in a concentration of at least 1 mol % with respect to said photosensitive silver halide.

* * * * *

UNITED STATES PATENT AND TRADEMARK OFFICE

CERTIFICATE OF CORRECTION

PATENT NO. : 6,576,415 B2 
DATED : June 10, 2003
INVENTOR(S) : Uytterhoeven et al.

It is certified that error appears in the above-identified patent and that said Letters Patent is hereby corrected as shown below:

Column 29,
Lines 43 and 65, "200° C" should read -- 20° C --.

Column 30,
Line 28, "water metal" should read -- water soluble metal --.
Lines 54-55, "dispersion prepared in wherein" should read -- dispersion prepared in step (ii) wherein --.

Signed and Sealed this

Twenty-eighth Day of October, 2003

JAMES E. ROGAN
*Director of the United States Patent and Trademark Office*